United States Patent [19]

Carlson

[11] 4,226,397

[45] Oct. 7, 1980

[54] PACKAGE SUPPORTING ASSEMBLY MEANS

[75] Inventor: Robert F. Carlson, Lafayette, N.J.

[73] Assignee: Stretch Wrap, Inc., Cedar Grove, N.J.

[21] Appl. No.: 11,492

[22] Filed: Feb. 12, 1979

Related U.S. Application Data

[62] Division of Ser. No. 900,872, Apr. 28, 1978, Pat. No. 4,166,348.

[51] Int. Cl.[3] ..... E04G 3/00

[52] U.S. Cl. ..... 248/274; 414/667

[58] Field of Search ..... 248/274, 309 R; 414/667, 671

[56] References Cited

U.S. PATENT DOCUMENTS

| | | | |
|---|---|---|---|
| 1,394,302 | 10/1921 | Hinsdale | 248/274 X |
| 2,035,301 | 3/1936 | Daugherty | 248/274 |
| 2,302,812 | 11/1942 | Stempel | 248/274 X |
| 2,641,815 | 6/1953 | Leighton | 248/274 X |
| 2,709,494 | 5/1955 | Luce | 248/309 UX |
| 2,748,966 | 6/1956 | Gohrke | 414/667 |

*Primary Examiner*—J. Franklin Foss
*Attorney, Agent, or Firm*—Daniel H. Bobis

[57] ABSTRACT

A tension wrap packaging machine has a supporting frame and a driving assembly mounted in the supporting frame, a main drive shaft is mounted in the supporting frame and at one end has a combined supporting member and safety closure disc fixedly connected thereto to be rotated by the drive shaft when the driving assembly is in operation. Mounted and rotatable with the combined supporting member and closure disc are a package supporting assembly for supporting a package to be wrapped thereon and in spaced relation thereto a wrapping material supporting assembly for the material to wrap the package. Package supporting assembly and wrapping material supporting assembly in addition to rotating with the closure disc are independently rotatable, the package supporting assembly being rotated by a planetary driving means, and the wrapping material supporting assembly being rotated by an auxiliary driving means operatively connected between the driving assembly and wrapping material supporting assembly.

The package supporting assembly includes means to support packages of varying sizes within a given range.

1 Claim, 26 Drawing Figures

PACKAGE SUPPORTING ASSEMBLY MEANS

This is a division of application Ser. No. 900,872, filed Apr. 28, 1978 now U.S. Pat. No. 4,166,348.

BACKGROUND OF THE INVENTION

This invention relates generally to machinery for wrapping a package and more particularly to a package wrapping machine which creates a unitary package utilizing a self-adhering wrapping material which is applied to the package under a predetermined amount of force or tension.

It is known in the prior art that a palletized package can be stretch wrapped using polyethylene material as is shown and described in U.S. Pat. Nos. 3,867,806, 3,793,798 and 3,003,297.

The present invention provides an improved stretch-wrap packaging machine and apparatus which is adapted to hold and wrap small packages and loads primarily those to be shipped by parcel post and United Parcel Service.

The present invention provides such improved packaging machine or apparatus having a main driving assembly for rotating a combined supporting member and safety closure disc on which a package supporting assembly for supporting a package to be wrapped and a wrapping material supporting assembly for the wrapping material for wrapping the package are disposed for independent and counter-clockwise rotation relative each other. The package supporting assembly is rotated by a planetary drive and the wrapping material supporting assembly is rotated by an auxiliary driven means operated off of the main driving assembly. The auxiliary driven means includes means for regulating the force or torque required to remove the wrapping material from the wrapping material supporting assembly so as to apply the desired tension to the wrapping material when the package is being wrapped.

The package supporting assembly includes means thereon for adjustably supporting packages of varying sizes within a given range.

The wrapping material supporting assembly includes, unique means forceably gripping the ends of the roll of wrapping material to simply and effectively hold it on the wrapping material supporting assembly and for transmitting the frictional torque or adjustable force exerted on the mounted roll of dispensing material to adjust the tension thereof. Additionally means are provided on the wrapping material supporting structure to move it to and fro along an axis parallel to the axis of rotation for the wrapping material supporting member.

SUMMARY OF THE INVENTION

Thus, the present invention covers an improved tension-wrap packaging machine for wrapping a package preferably with self-sealing wrapping material applied to the package with a predetermined amount of tension so as to provide a unitary package including, a supporting frame, a main driving shaft, means for rotating the main driving shaft, support member means connected to and rotatable with the main driving shaft, said support member means having a package supporting assembly and a wrapping material supporting assembly mounted on and rotatable therewith, planetary drive means for rotating the package supporting assembly independent of the support member means, auxiliary driven means operated by the main driving assembly for rotating the wrapping material supporting assembly independent of the support member means and having means to adjust the force or torque required to remove the wrapping material from the wrapping material support assembly, and said package supporting assembly and wrapping material supporting assembly disposed on said support member means for counter rotation relative each other.

Accordingly it is an object of the present invention to provide an improved packaging machine for forming a unitary package which accomodates packages of varying sizes, stabilizes the package during the wrapping thereof, and tensions the wrapping material used for wrapping the package.

It is another object of the present inventiion to provide an improved packaging machine adapted to accomodate a package or load to be wrapped to stabilize the package during the wrapping thereof by counter-clockwise movement of the package relative the wrapping material and by tensioning the wrapping material during the wrapping of the package.

It is another object of the present invention to provide a package supporting assembly for supporting a package which includes means for supporting packages of varying widths and length within a given range.

It is another object of the present invention to provide a package supporting assembly which is driven by a planetary driving system.

It is another object of the present invention to provide a wrapping material supporting assembly which includes, improved means for gripping and transmitting frictional forces to the roll of wrapping material mounted thereon, and means for varying the axial position of the wrapping material along the axis of rotation for the wrapping material supporting assembly.

It is another object of the present invention to provide an auxiliary driven means for driving the dispensing roll supporting assembly for a packaging machine which includes, a magnetic or the like electrical control clutch for applying adjustable tension to the wrapping material being dispensed by the wrapping material supporting assembly.

With these and other objects the features and advantages of the invention will become apparent from the following more detailed description of a preferred embodiment of the invention as illustrated in the accompanying drawings.

BRIEF DESCRIPTION OF THE DRAWINGS

Referring to the drawings FIGS. 1 to 5 show a preferred form of tension wrap packaging machine generally designated 10 in accordance with the present invention having a supporting frame assembly 11 which is mounted on spaced legs as at 12*a* and 12*b*.

Figure 1:
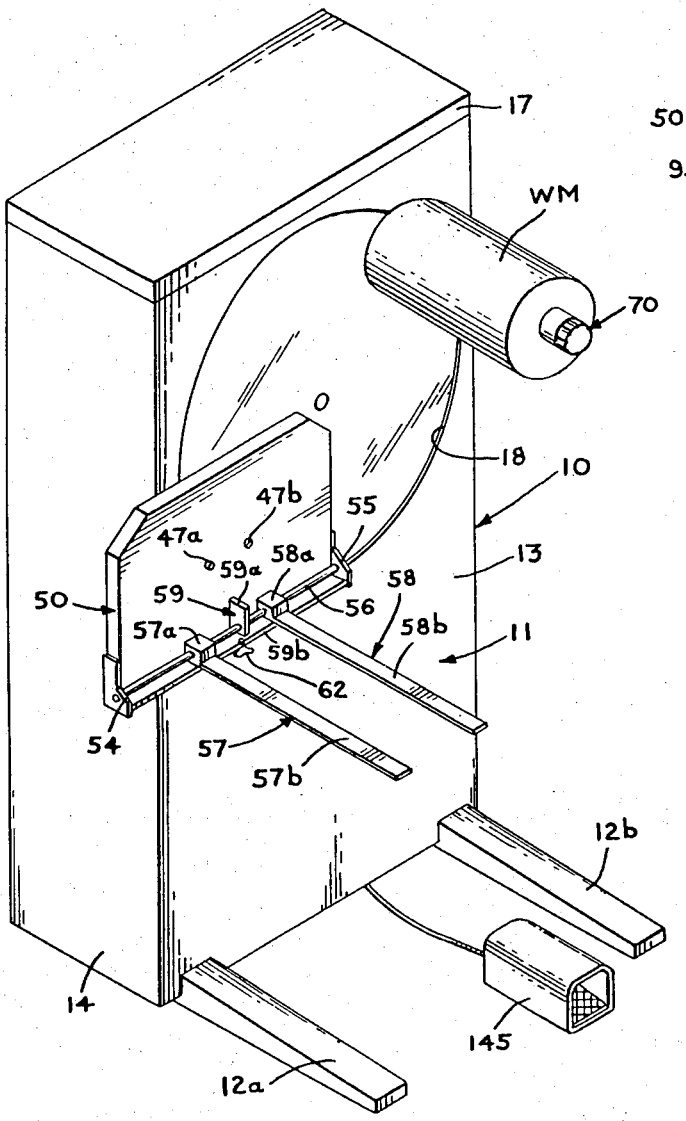
FIG. 1 is a perspective view of one form of tension wrap packaging machine in accordance with the present invention.

Supporting frame assembly is generally rectangular in horizontal section and is elongated in the vertical direction. It is formed with a front panel 13, a left side panel 14, a right side panel 15, a rear panel 16, and a removable top cover 17.

The front panel is provided with a cylindrical opening as at 18 and the rear panel is provided with an enlarged square opening as at 19 having a removable rear cover 19*a* to facilitate access to the various assemblies for rotating and driving the various elements for holding a package to be wrapped and the wrapping materials to be wrapped about the package all as will be more fully described hereinafter.

MAIN DRIVING ASSEMBLY

Figure 6:
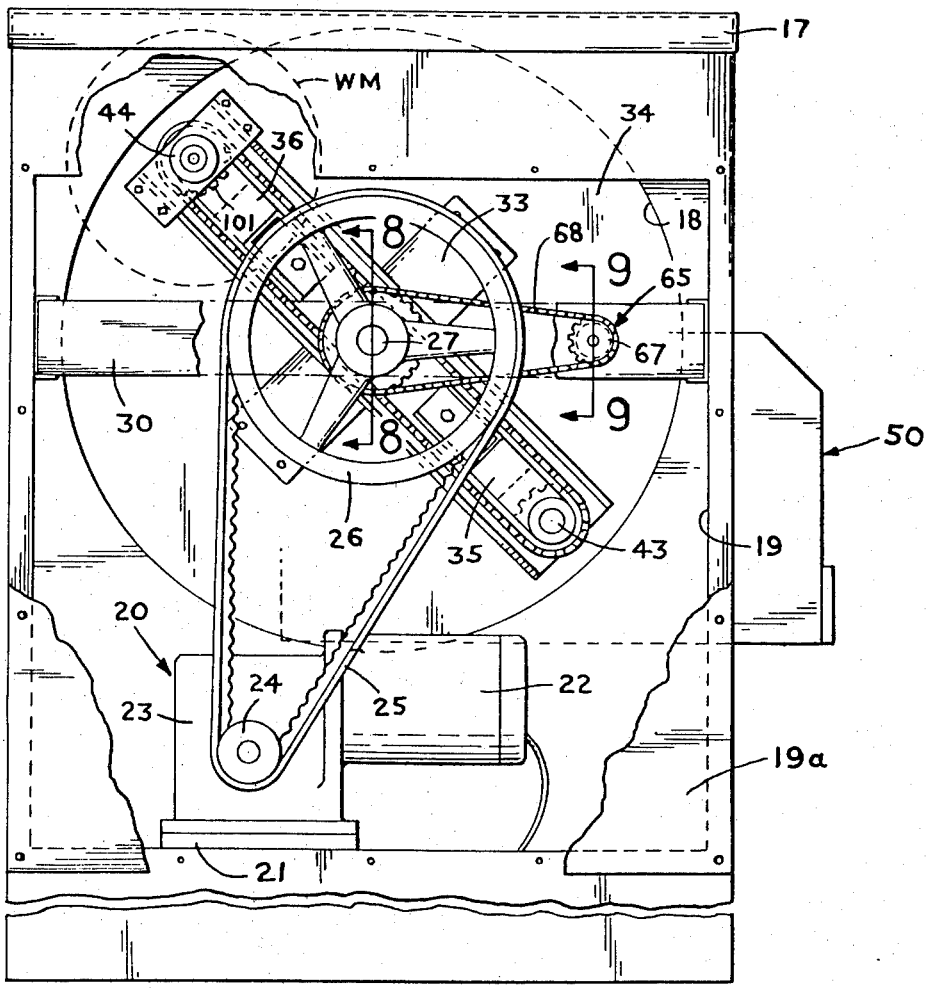
FIG. 6 is a rear elevational view of the tension wrap packaging machine shown in FIGS. 1 to 4 with the back panel of the housing removed, a portion of the supporting frame broken away, and the back outline shapes of package supporting assembly and wrapping material supporting assembly shown in dashed lines.
Figure 7:
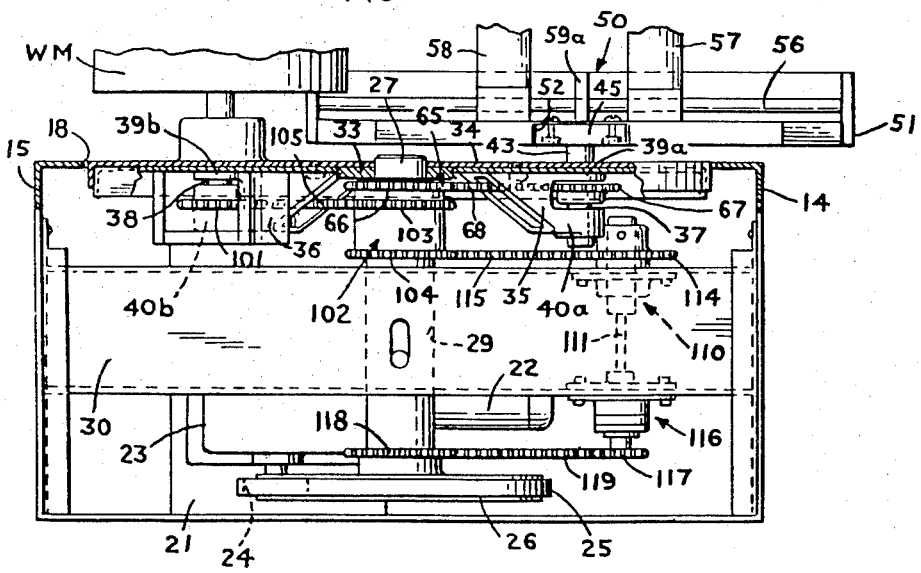
FIG. 7 is a top view with the cover removed of the tension wrap packaging machine shown in FIGS. 1 to 4 of the drawings.
Figure 8:
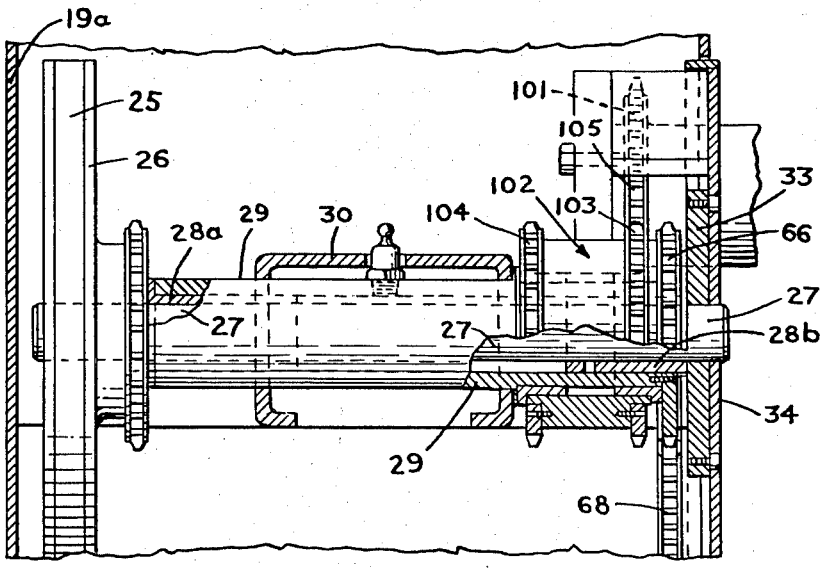
FIG. 8 is a vertical section along the main drive shaft taken on line 8—8 of FIG. 6.

The main driving assembly generally designated 20 is mounted on a shelf 21 which is disposed transversely to the vertical axis of the supporting frame 10 about the mid point thereof and is held between the front panel, and the back panel as is shown in FIGS. 6 and 7 of the drawings.

The main driving assembly 20 includes an electric motor 22 which is connected to a reductiongear means 23 for driving a gear or pulley 24.

Gear or pulley 24 is connected by belt 25 to a main driving gear or pulley 26 in turn connected to one end of the main driving shaft 27, the gears 24 and 26 being so sized that the main driving pulley 26 will rotate the main driving shaft 27 at approximately 10 to 12 R.P.M.

The main driving shaft 27 is mounted by suitable bearing means 28*a* and 28*b* in a bearing housing 29 which is supported on a transverse beam 30 fixedly connected by any suitable means to the left side panel 14 and to the right side panel 15 of the supporting frame 11, as is also shown in FIGS. 6 and 7.

FIG. 7 shows that the main drive shaft 27 extends a sufficient distance so that the end remote from the main driving pulley 26 can be fixedly connected to the support member 33 which is in turn fixedly connected to a circular safety disc 34 which is sized so as to close the opening 18. Thus, the supporting assembly consisting of the support member 33 and disc 34 acts to improve the appearance of the supporting frame 11 by concealing the various driving assemblies for the tension wrap packaging machine 10 and as a safety mechanism to reduce the hazards to persons operating the tension wrap packaging machine 10 which can arise where rotating parts and elements of a machine are exposed.

Since the supporting member 33 and disc 34 are fixedly connected to the main driving shaft 27. Each time that the driving shaft 27 is rotated, these elements will rotate therewith at the same speed.

Connected to the inner face of the disc 34 are bearing supports as at 35 and 36 which are disposed on opposite sides of the axis of rotation for the disc 34 for reasons that will be clear when the operation of the tension wrap packaging machine is described below.

The bearing supports 35 and 36 are block like members having kerfs or slots as at 37 and 38 extending inwardly from the side faces thereof so as to define a front leg and a rear leg one each of the respective bearing supports as at 39*a* and 40*a* for bearing support 35 and 39*b* and 40*b* for bearing support 36. The respective front leg 39*a* and rear leg 40*a* have a supporting shaft 43 rotatably mounted therein, and the front leg 39*b* and rear leg 40*b* have a supporting mandril or supporting shaft 44 rotatably mounted therein as is shown in FIGS. 6 and 7.

In assembled position the supporting shaft 43 and supporting mandril or shaft 44 will be rotated by suitable driving assemblies, more fully described below, about axis parallel to the axis of rotation for the safety disc 34 but spaced radially therefrom as is shown in FIGS. 6 and 7 of the drawings.

Figure 2:
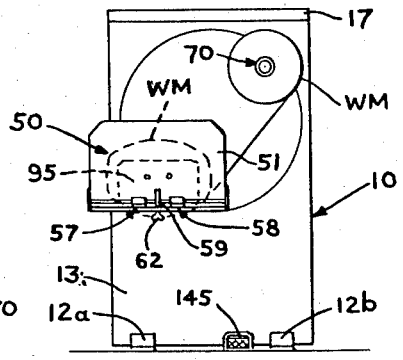
FIG. 2 is a front view of the tension wrap packaging machine shown in FIG. 1.
Figure 3:
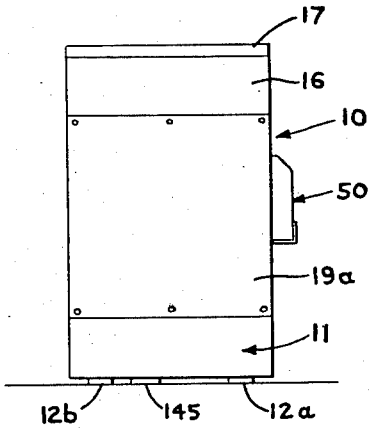
FIG. 3 is a rear view of the tension wrap packaging machine shown in FIGS. 1 and 2 of the drawings.
Figure 4:
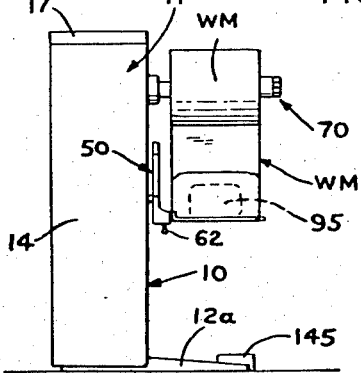
FIG. 4 is a left side view of the tension wrap packaging machine shown in FIG. 2.
Figure 5:
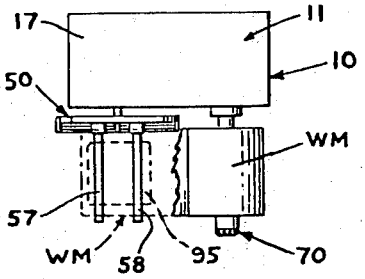
FIG. 5 is a top view of the tension wrap packaging machine shown in FIG. 1.

The supporting shaft 43 extends through the safety disc 34 beyond the front face thereof and a shaped bracket 45 fixedly connected to the end thereof a spaced distance from the front face of the safety disc 34 permits a package supporting assembly 50 to be mounted thereon so that the package supporting assembly 50 will be rotated in juxtaposition to the front face of the safety disc 34 and about the axis of rotation for the supporting shaft 43 as is also shown in FIGS. 1, 2 and 7 of the drawings.

PACKAGE SUPPORTING ASSEMBLY AND PLANETARY DRIVE THEREFORE

Package supporting assembly 50 as shown in FIGS. 1, 2, 4, 5 and 11 to 14 includes, a back plate 51 which is disposed perpendicular to the axis of rotation for the supporting shaft 43 by a slotted bracket 52 on the back face thereof for connecting the package supporting assembly to the shaped bracket 45. Slots 46 permit threaded elements 47*a* and 47*b* to engage and lock or hold the back plate in any adjusted positions within the range of the slots.

Back plate 51 can have any given shape and will be sized to receive and accomodate a range of packages having various heights within the range of the back plate 51. The lower face 53 of the back plate is square or linear and spaced members 54 and 55 extending from the sides of the back plate 51 adjacent the respective ends of the square or linear face 53 to support therebetween a guide rail 56 on which are slidably mounted a pair of coating arms 57 and 58, which can be locked in a given position along the guide rail 56 by a locking assembly generally designated 59.

The arms 57 and 58 are elongated members of predetermined length to support a concomitant range of package lengths and include, hubs, as at 57*a* and 58*a* and elongated flat support sections as at 57*b* and 58*b*. The hubs have transverse openings therethrough, so they can be mounted on the guide rail 56 to permit the support sections 57*b* and 58*b* of the respective arms 57 and 58 to be disposed in spaced relation as a function of the given width of the sized package to be wrapped by the tension wrap packaging amachine.

The locking assembly 59 includes, a centrally disposed threaded bore 60 in locking assembly support block 59*a*, an opening 61 in locking strip 59*b* is aligned with the bore 60, so that a manually operable thumbscrew 62 can be extended through the opening 61 into the threaded bore 60 and can move a cooperating locking washer 63 disposed between the locking strip 59*b* and the thumbscrew 62 into engagement with the locking strip 59*b* causing the same to move towards and away from the lower face 53 of the back plate 51 and thus to lock the hubs 57*a* and 58*a* in the spaced positions at which they are set on the guide rail 56. On threaded movement in the opposite direction the hubs 57*a* and 58*a* of the arms 57 and 58 will be released to permit the same to be repositioned as may be necessary for a package to be wrapped having a different width requirement as may be the case.

The package supporting assembly 50 will be initially positioned so that the upper surface of the supporting sections 57*b* a and 58*b* of the respective supporting arms 57 and 58 are disposed in a parallel plane perpendicular to a vertical plane extending through the axis of rotation for the safety disc 34. Further, however, when the safety disc 34 is rotated by the main driving assembly, the supporting shaft 43 and the package supporting assembly 50 also will be rotated independently of the rotating safety disc 34 so that the upper surface of the respective supporting sections 57*b* and 58*b* will at all times be maintained in a horizontal plane perpendicular to the vertical plane through the axis of rotation for the safety disc 34. A planetary driving assembly generally designated 65 is provided for this purpose.

Planetary driving assembly 65 includes, a stationary gear 66, which is connected to the front end of the bearing housing 29 for the main driving gear 27. Stationary gear 16 lies concentric to the axis of rotation for the safety disc 34.

A connecting gear 67 on the supporting shaft 43 rotatably mounted in suitable bearing means, not shown on the front leg 39*a* and the rear leg 40*a*, lies in the same plane as the stationary gear 66, and a connecting chain 68 connects the stationary gear 66 to the driven connecting gear 67 on the shaft 43. When the safety disc 34 is rotated, the shaft 43, by reason of the planetary driving assembly 65, is caused to turn or rotate through 360°, which is a function of the pivotal and incremental movement of the connecting chain 68 about the stationary gear 66. Since this turning of the supporting shaft 43 is a function of the angular pivotal and incremental movement about the stationary gear 66, the package supporting assembly 50 is moved in the same relative horizontal position at all circumferential positions to which the shaft 43 is moved during the rotation of the safety disc 34.

WRAPPING MATERIAL SUPPORTING ASSEMBLY AND AUXILIARY DRIVE WITH CLUTCHING MEANS

The supporting mandril 44 is an elongated shaft having a length about equal to the length of the respective arms 57 and 58 of the package supporting assembly 50. Similar to the supporting shaft 43, supporting mandril 44 extends through the safety disc 34 so that it projects a substantial distance beyond the front face of the safety disc along an axis parallel to the axis of rotation for the safety disc but spaced radially therefrom a sufficient distance to enable a wrapping material supporting assembly generally designated 70 to be mounted thereon and to support a roll of wrapping material generally designated WM as shown in FIGS. 1 to 4 and 17 to 25 of the drawings.

The elongated supporting mandril 44 provides the inner member of the wrapping material supporting assembly 70 and has a guideway or groove 71 milled in the outer surface thereof. Mounted on the supporting mandril 44 is a hollow cylindrical outer member 72 having a bore 73 end to end therethrough sized for a sliding fit relative the outer surface of the supporting mandril 44. The outer member 72 has roller bearing means 74 which is sized to fit and to roll in the guideway or groove 71 when the outer member 72 is telescoped to and fro relative the longitudinal axis of the inner member 71.

The outer diameter of outer member 72 is sized so that the hollow core 75 of the roll of wrapping material WM can be fitted thereon. At the inner side of the outer member 72 adjacent the front face of the safety disc 34 an annular shoulder 76 is provided and the inner side of the hollow core 75 will abut against the annular shoulder 76 in assembled position. A gripping member 76 on the face of the shoulder 76 will bite into the end of the hollow core 75 in assembled position.

Outboard of the outer end of the outer member 72 remote from the annular shoulder 76 a sized gripping member 78 is disposed on a manually movable threaded holding assembly generally designated 80. The gripping member 78 is disposed to bite into the outer end of the hollow core 75 and coacting with gripping member 76 will hold and fixedly connect the roll of wrapping material WM so that on rotation of the wrapping material support assembly the pay off of the wrapping material can be both controlled and the tension adjusted thereon by suitable driving means hereinafter described.

Thereaded holding assembly 80 includes a threaded section 81 which is adapted to engage a threaded section 82 on the outboard end of the outer member 82 and a knurled handle 83 provides means for threading the threaded section so as to move the gripping element connected thereon into and out of engagement with the hollow core 75.

Figure 24:
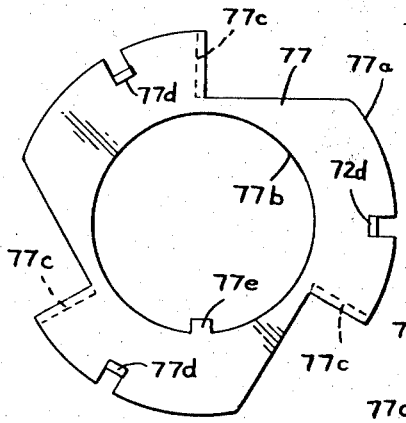
FIG. 24 is a rear view of the gripping element shown in FIG. 23.
Figure 25:
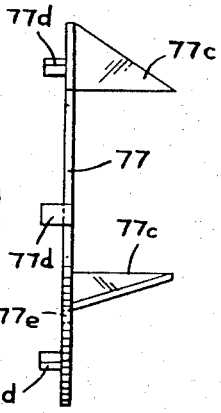
FIG. 25 is a side view of the gripping element shown in FIG. 23.
Figure 23:
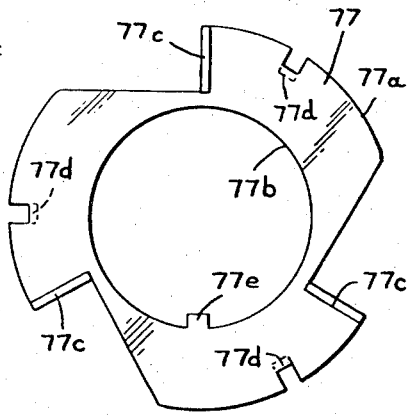
FIG. 23 is a front view of one of the gripping elements shown in FIGS. 17, 18 and 19.

Gripping members 77 and 78 have substantially the same construction and only gripping member 77 is therefor illustrated at FIGS. 23, 24 and 25 as a formed annular member struck from sheet metal by any suitable means as will be understood by those skilled in the art. The character numerals recited for Gripping member 76 are also applicable to gripping member 78.

Each gripping member has an outer annulus or peripheral edge as at 77*a* and an inner annulus or inner circumferential edge as at 77*b*. Spaced triangular elements as at 77*c* extend or project from one face of the gripping member. In assembled position the pointed end of the triangular elements 76*c* on each gripping element extend into the hollow portion of the core 75 and the angle sides of the triangular elements will be sharp enough to bite into the respective ends of the core 75.

Spaced lugs as at 77*d* offset from the peripheral edge 77*a* and an inwardly extending key 77*e* offset from the inner circumference 77*b* provides means for holding the respective gripping members 76 and 78 in assembled position on the annular shoulder 76 and on the threaded holding assembly 80, all of which is shown in FIGS. 17, 19, 23, 24 and 25 of the drawings.

The threaded holding assembly 80 includes an annular member 80*a* which as indicated above is threaded on its inner annulus as at 81 to permit the threaded holding assembly 80 to be threaded on and off the threaded portion 82 on the outer member 72.

Figure 18:
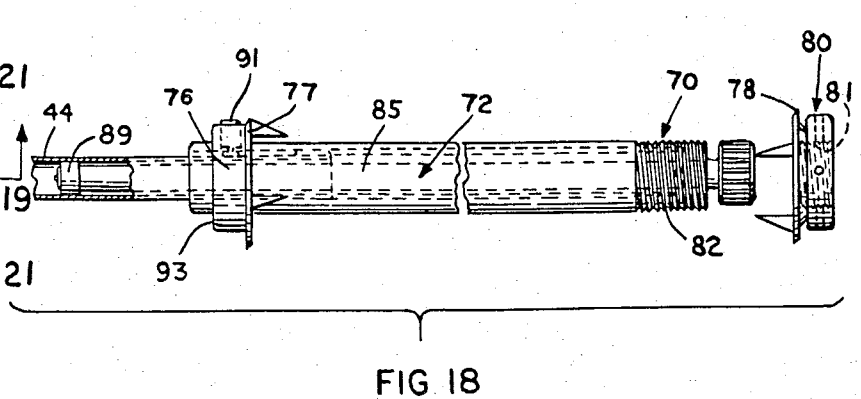
FIG. 18 is a partial view of the wrapping material supporting assembly without the wrapping material thereon having the outer hollow shaft move laterally with respect to the inner driving mandril and partially exploded to show the movable gripping element for gripping the outer end of the core for the wrapping material.
Figure 17:
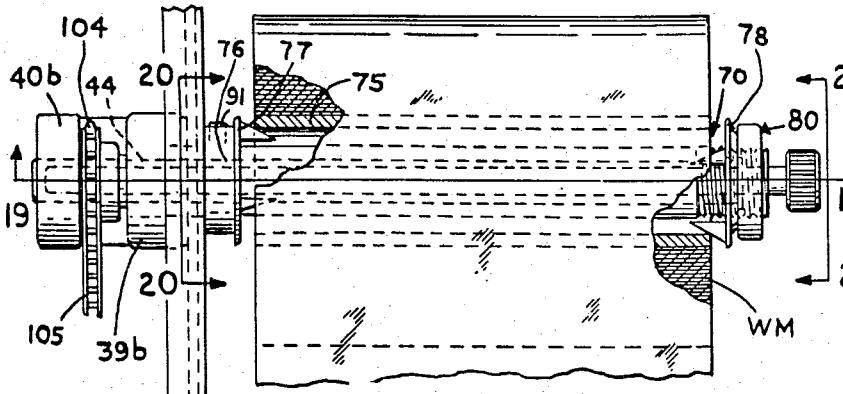
FIG. 17 is an enlarged view of the wrapping material supporting assembly with the wrapping material thereon.
Figure 19:
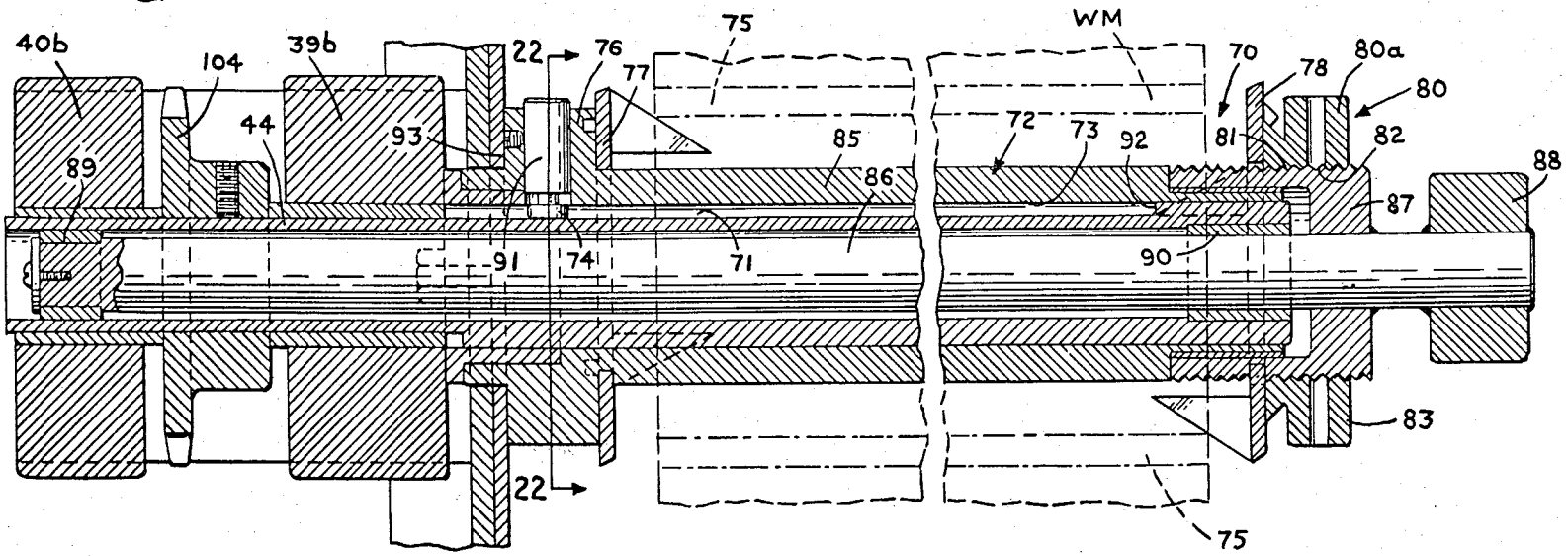
FIG. 19 is a longitudinal section taken on line 19—19 of FIG. 17.
Figure 20:
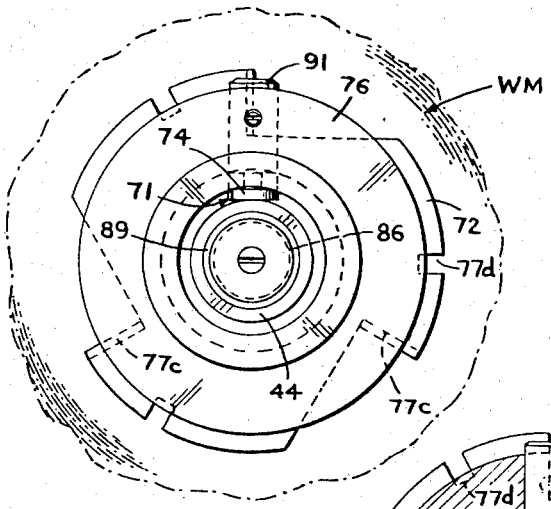
FIG. 20 is a view taken from the inner end of the wrapping material supporting assembly on line 20—20 of FIG. 17.
Figure 21:
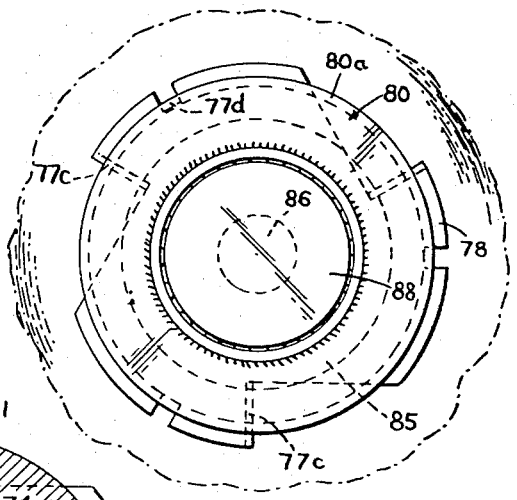
FIG. 21 is a view taken from the outer end of the wrapping material supporting assembly on line 21—21 of FIG. 17.
Figure 22:
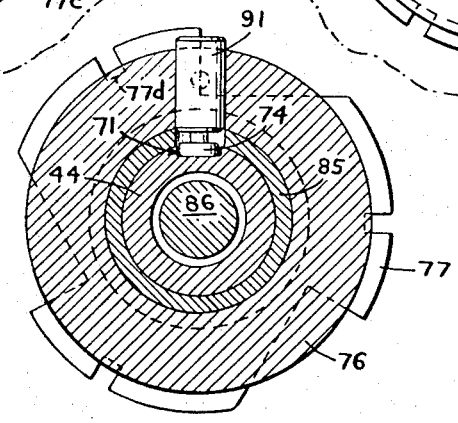
FIG. 22 is a cross-section taken on line 22—22 of FIG. 19.

On one side of the threaded annular member 80*a* an undercut annular flange 83 is formed to provide means for mounting the gripping member 78 as by lugs 77*d* which are bent to engage the peripheral edge of the undercut and thus bring the outer face of the gripping member 78 into abutment with the face of the undercut annular flange 83 so that the triangular elements 77*c* face inwardly towards the core 75 of the wrapping material WM when the threaded holding assembly 80 is threaded onto the outer member 72, as is shown in FIGS. 17, 18 and 19 of the drawings.

Threaded holding assembly 80 is sized to permit the annular member 80*a* to be gripped and rotated so as to thread the same in or off the outer member 72. When the threaded holding assembly 80 is threaded off the outer member, a roll of wrapping material WM may be placed in position on the outer member 72 of the wrapping material supporting assembly 70 or an empty core may be removed. After a new roll is placed into position on the outer member 72, the threaded holding assembly 80 can be threaded so as to bring the respective inner gripping element 76 and outer gripping element 78 into tight holding and gripping engagement with the respective ends of the core 75 for the new roll of wrapping material WM.

Outer member 72 on which the wrapping material is mounted includes the outer hollow cylindrical member 85 and a central elongated shaft 86 which are fixedly connected by an end cap 87 as shown in FIG. 19. It will be understood that hollow cylindrical member 85 and the elongated central shaft 86 may be cast, molded or formed as a single element without department from the scope of the present invention.

A handle 88 is formed on the exterior end of the outer member 72 for sliding the same axially as will now be described.

The outer member 72 is disposed so that the elongated central shaft 86 extends into the hollow cylindrical support mandril 44 and spaced bearings as at 89 on the inner end of the central shaft 86 and 90 on the outer end of the mandril 44 permits the central shaft 86 to be slidably disposed in the mandril 44.

The inner annular element 76 is fixedly connected to the interior edge of the outer member 72 and the inner gripping element 76 is fixedly connected thereto. A bearing holder 91 transversly disposed in the inner annular element 76 holds the roller bearing 74 which rides and rolls in groove 71 on the inner support mandril 44.

The groove 71 has an automatic stop as at 92. On inward movement the inner or interior face 93 of the inner annular element 76 acts as an inner stop to the inward sliding movement of the outer member 72 and relative the inner support mandril 44 and the stop shoulder 92 acts as an outer stop to the outward sliding movement of the outer member 72.

It will be clear that such sliding movement can be effected by manually gripping the handle 88 an exerting pulling or pushing forces thereon to place the wrapping material roll at the desired position for paying off the wrapping material from the roll at the desired position relative the package 95 to be wrapped as is shown in FIGS, 2, 4 and 5 of the drawings.

Wrapping material supporting assembly 70 will be rotated with the safety disc 34 and in addition, will be rotated independently thereof about the longitudinal axis of the supporting mandril by an auxiliary driving assembly which includes clutching means for adjusting the rate and tension of the wrapping material being paid out off of the wrapping machine roll WM.

Thus, referring to FIGS. 8, 9, 17 and 19, the supporting mandril 44 has a driving gear 101 connected to the section of the supporting mandril between the front leg 39*b* and rear leg 40*b* of the bearing support 36. Driving gear 101 coacts with an intermediate power transfer 102 which is a cylindrical element rotatably connected on the housing for the main driving shaft 14 by suitable bearings, not shown, which permit the free rotation thereof concentric to the axis for rotation of the main shaft 14 and the safety disc 34 connected thereto.

Intermediate power transfer assembly 102 has a front gear 103 and a rear gear 104 which are fixedly connected and rotatable with the cylindrical center portion thereof. The front gear 103 is in the same plane as the driving gear 101 on the supporting mandril 44 and the driving gear 101 and front gear 103 are connected by a continuous chain 105.

The driving force for rotating and for adjusting the driving force transmitted to the front gear 103 and the driven gear 101 through connecting chain 105 is transmitted to the rear gear 104 of the intermediate power transmitting assembly 102 through an auxiliary driving assembly generally designated 110.

Auxiliary driving assembly 110 includes, an auxiliary driving shaft 111 which is rotatably mounted in suitable spaced bearings 112 and 113 connected to the transverse supporting beam 30. The auxiliary driving shaft 101 is sufficiently long to extend in opposite directions beyond the sides of the transverse supporting beam and at the end adjacent the safety disc 34 is provided with a connecting gear 114 which is in alignment with rear gear 104 on the intermediate power transmitting assembly 102 to permit a continuous chain 115 to connect these gears in driving engagement.

Figure 9:
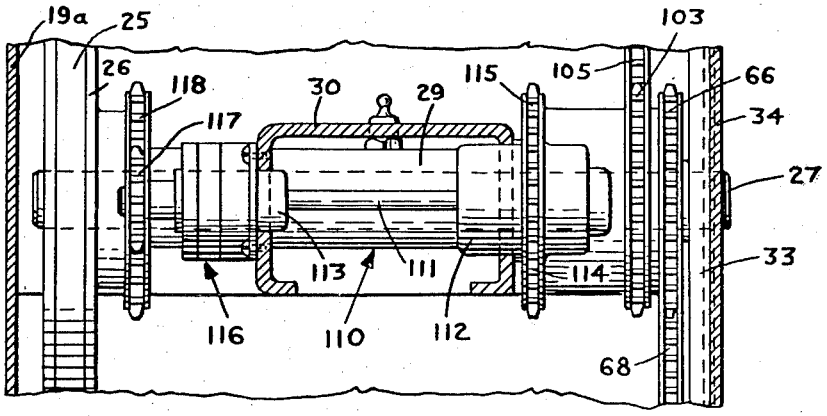
FIG. 9 is a vertical section taken on line 9—9 of FIG. 6.
Figure 10:
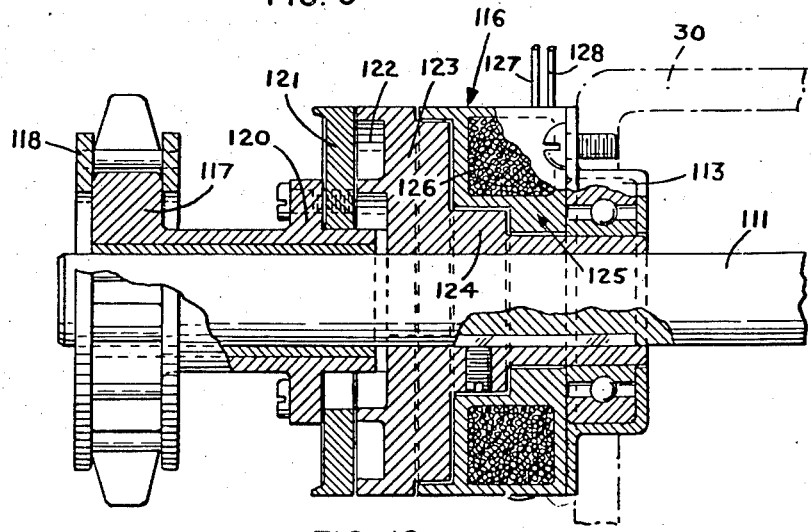
FIG. 10 is an enlarged view of the magnetic clutch for the auxiliary drive assembly.
Figure 11:
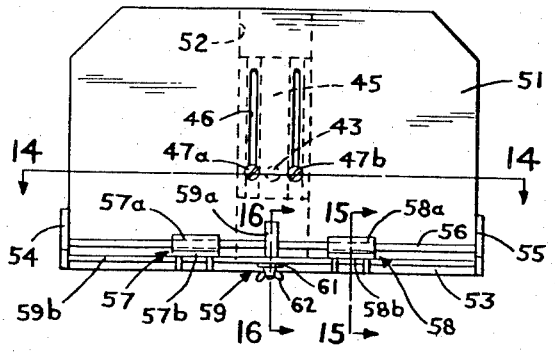
FIG. 11 is an enlarged front view of the package supporting assembly shown in FIGS. 1 to 5.
Figure 12:
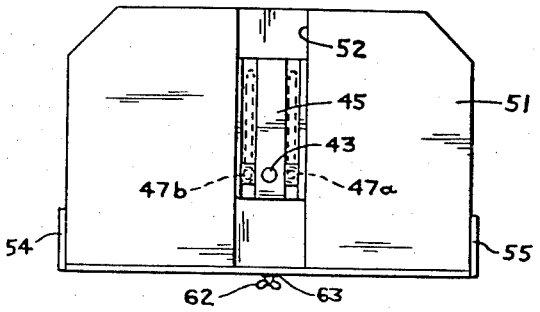
FIG. 12 is an enlarged rear view of the package supporting assembly shown in FIGS. 1 to 5, and 11.
Figure 13:
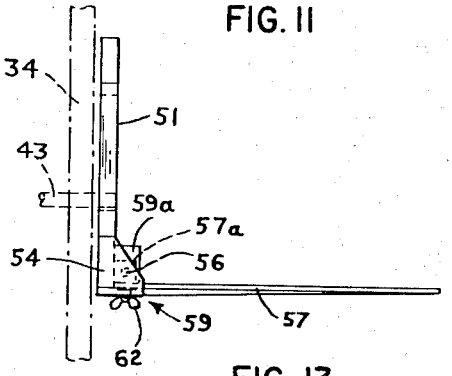
FIG. 13 is an enlarged left side view of the package supporting assembly shown in FIGS. 1 to 5, 11 and 12.
Figure 16:
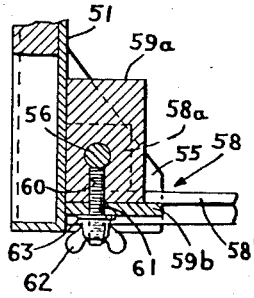
FIG. 16 is a vertical section taken on line 16—16 of FIG. 11.
Figure 15:
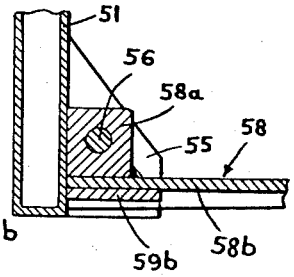
FIG. 15 is a vertical section taken on line 15—15 of FIG. 11.

On the rear end remote from the connecting gear 114 is a magnetic clutching assembly 116. Magnetic clutching assembly 116 includes, a connecting sprocket 117 disposed in alighment with a driving sprocket 118 fixedly connected and rotatable with the main drive shaft 27. Power can be transmitted from the driving sprocket 118 to the connecting sprocket 117 by means of a power transmitting continuous chain drive 119, all of which is shown in FIGS. 6, 7, and 9 of the drawings.

Thus, when the main driven gear 27 is rotated driving sprocket 118 conencted on the main driving shaft 27 will also be rotated and will transmit power through the chain drive 119 to the connecting sprocket 117 which in turn will transmit power through the magnetic clutch 116 to the auxiliary shaft 111. The auxiliary shaft 111 in turn will transmit power through connecting gear 114 and chain drive 115 to the rear gear 104 of the intermediate power transmitting assembly 102 causing it to rotate independently of the rotation of the main shaft 27. The driving force transmitted by front gear 103 and connecting chain 105 to the driving gear 101 on the elongated supporting mandril 44 will rotate the same and the wrapping material supporting assembly 70 with the force and torque transmitted through the auxiliary driving assembly 110.

The driving force transmitted through this auxiliary driving assembly 110 will be regulated by the magnetic clutch 115, and can be controlled by the operator of the machine through a suitable electrical control system to be described in more detail below.

The magnetic clutch 115 is purchasable on the open market and one such clutch adapted for use in connection with the tension wrap packaging machine in accordance with the present invention is model EC-17c-4 Coil Number 1, Style "L" manufactured and sold by Electroid Company. This device acts to apply more or less frictional engagement to the connecting sprocket 117 so as to adjust and regulate the amount of rotational force or torque transmitted to the auxiliary driving shaft 111.

Thus, FIG. 9 shows that the connecting sprocket 117 is fixedly connected to the rear end of the auxiliary shaft 111 and to a hub portion 120 on the magnetic clutch 115. Hub portion 120 is provided with an annular metal friction shoe 121. A corresponding and mating metal friction shoe 122 is provided on an armature 123 which is mounted in a rotor 124 fixedly mounted on and rotatable with the auxiliary driving shaft 111. The rotor is operatively associated with a coil assembly 125 which is fixed to the transverse support beam 30. Current is delivered to the coil field 126 in the coil assembly 125 through electrical current supply lines 127 and 108 and the magnetic flux exerted by the coil field 126 will be determined by the amount of electrical current applied thereto through the lines 127 and 128.

As electrical current is applied to the coil field, it will induce a corresponding magnetic flux in the armature 123 and this will produce a corresponding magnetic field in the metal friction shoes 122 which will effect the mating metal friction shoes 121. Thus, the driving force transmitted from the connecting sprocket 117 to the auxiliary driving shaft 111 and the train of driving gears to the wrapping material supporting assembly 70 will be adjusted as a function of the magnetic flux exerted in the clutch mechanism and the control system for operating the main driving assembly and auxiliary driving assembly as will now be described.

CONTROL SYSTEM

Figure 26:
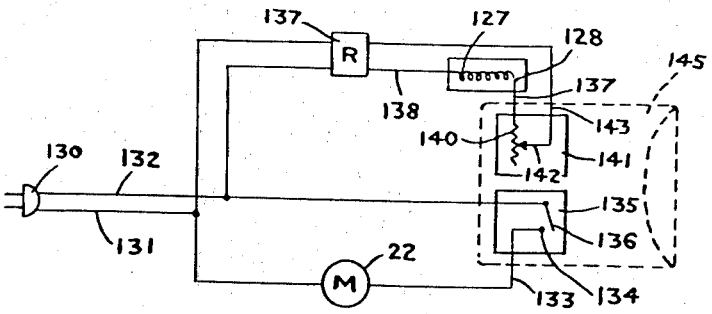
FIG. 26 is a schematic drawing of the electrical circuit and the associated elements of the switch for starting and stopping the motor of the main driving assembly and the control for adjusting the clutch of the auxiliary driving assembly.

FIG. 26 shows that the control system for operating the tension wrap packaging machine in accordance with the present invention is relatively simple and utilizes a conventional 110 volt A.C. circuit. Therefore a conventional electric plug 130 is provided for connecting the control circuit into any conventional wall outlet, not shown.

The electrical circuit carrying 131 and 132 from the plug 130 are connected to two parallel current carrying circuits. One circuit is for operating the motor 22 and the other circuit is for adjusting the flux applied to the coil field 126 of the clutch mechanism 115. Thus, line 131 is connected to one side of the coil field for the motor 22. The other side of the coil field, in turn being connected by line 133 to the terminal 134 have a switch 135. The switching arm 136 of the switch 135 is connected to the line 132 so that when the switching arm 136 is moved into contact with the terminal 134 current will flow through the motor circuit and place the motor into operation and when the switch arm is out of contact with the terminal 134, the motor circuit will be open, and the motor will cease operating.

Lines 131 and 132 are also connected to a rectifier 137 which converts the A.C. current to D.C. current required to operate the coil field 126 of the clutch mechanism 115. Thus, D.C. line 138 leads from the rectifier to line 127 for coil field 126 and connecting line 139 leads from line 128 of the coil field 126 to the resistance 140 of a conventional potentiometer 141 of the type well known and understood by those skilled in the art. D.C. line 142 leads from the movable contact 143 to the rectifier 137 to complete the circuit as will be understood by those skilled in the art, the movable arm can be moved relative the resistance 140 to adjust the amount of current applied to the coil field 126 of the clutch mechanism 115.

Figure 14:
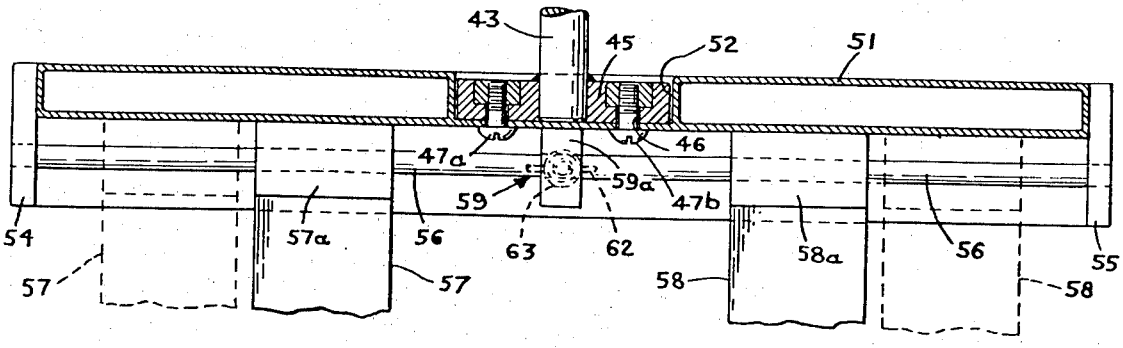
FIG. 14 is an enlarged top view of the package supporting assembly shown in FIGS. 1 to 5, 11, 12, and 13 partly in horizontal section on line 14—14 of FIG. 11.

The switch 135 and potentiometer 141 are disposed in a common control housing 145 shown in dashed lines in FIG. 14 which is shaped so that the operator of the tension wrap packaging machine can both switch the motor on and off and adjust the current applied to the coil field 126 of the clutch mechanism 115 so as to both place the tension wrap packaging machine into operation and to adjust the tension of the wrapping material applied to the package to be wrapped.

Particular attention is called to the wrapping material WM. Wrapping materials having self sticking and resilient physical properties typically may be polyvinyl chloride film of 75 mil thickness made up in rolls on a hollow core. Polyethylene films may also be used. However, it will be understood by those skilled in the art that other types of wrapping materials can also be used. For example, polyvinyl films may be used with a sealing tape or an adhesive backing and the use of such other materials are clearly within the scope of the present invention.

OPERATION

In operation, the arms or load bars 57 and 58 are set to the package width and locked in position by manual operation of the locking assembly 59.

A portion of the wrapping material is paid off of the wrapping material supporting assembly 70 and several turns thereof are wrapped about the arms or load bars to provide a platform for the package to be wrapped.

The package covered with insulating material, not shown, if required, is placed in position on the wrapped section of the arms or load bars 57 and 58 and the main driving assembly of the tension wrap packaging machine is started by depressing the foot-operated switch 135 and potentiometer 141 lightly. This allows the machine to dispense wrapping material without applying tension thereto and permits by reason of the counter rotation of the package and the wrapping material to wrap the wrapping material about the package for at least one revolution without tension thereon.

After the first revolution, the foot-operated switch 135 and potentiometer 141 is now depressed more heavily and the wrapping material is tightened about the load by establishing the proper tension thereon as a function of the frictional engagement established by the clutch means 115 of the auxiliary driving assembly 110 above described.

The tension wrap packaging machine 10 is then permitted to revolve as many revolutions as necessary to wind or wrap the wrapping material about the package so as to cover the same with the required amount of wrapping material.

After the package is wrapped, the machine is stopped, the wrapping material cut off, and the package is removed from the horizontal bars by sliding the same axially thereon. The ends of the wrapping material are closed by hand and the package is ready to be shipped.

In the event that additional wraps of wrapping material are desired from another or transverse direction to that of the initial application, the same may be applied by repeating the operational steps for the machine as above enumerated.

Thus, there has been described a tension wrap packaging machine for creating a unitary package having a plurality of layers of plastic material, tension wrap thereabout, which wrapped material in its preferred form, has sticking properties for sealing the package.

It will be understood that the invention is not to be limited to the specific construction or arrangement of parts shown but that they may be widely modified within the invention defined by the claims.

What is claimed is:

1. A package supporting assembly for a machine for wrapping a package including, a. back plate means having connecting means thereon, b. guide rail means connected to said back plate means, c. at least two elongated arms slidably mounted on said guide rail means for movement towards and away from each other, d. each of said elongated arms includes a hub portion, e. said hub portion having a bore therethrough for slidably mounting the same on said guide rail means, and f. means for holding and locking each of said respective elongated arms in any position the same are set on said guide rail means includes, 1. a resilient flat member connected adjacent the lowermost end of the back plate and disposed to engage the hub portion of the respective elongated members, and 2. a locking assembly connected to the back plate means operable to move the resilient flat member into locking engagement with said hub portion when the elongated arms are in a given setting to release the same to permit the position of the elongated arms to be changed.

* * * * *